US007699572B2

(12) United States Patent
Kaneko et al.

(10) Patent No.: US 7,699,572 B2
(45) Date of Patent: Apr. 20, 2010

(54) BOOKBINDING APPARATUS AND IMAGE FORMING SYSTEM

(75) Inventors: Masahiro Kaneko, Hino (JP); Tsuyoshi Tsuchiya, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 4 days.

(21) Appl. No.: 11/706,246

(22) Filed: Feb. 15, 2007

(65) Prior Publication Data

US 2008/0054546 A1 Mar. 6, 2008

(30) Foreign Application Priority Data

Aug. 30, 2006 (JP) ..... 2006-233326

(51) Int. Cl.

| | |
|---|---|
| ***B42C 9/00*** | (2006.01) |
| ***B05C 1/00*** | (2006.01) |
| ***B05C 11/00*** | (2006.01) |
| ***G03G 15/00*** | (2006.01) |

(52) U.S. Cl. ..... 412/37; 412/8; 118/241; 118/664; 399/408

(58) Field of Classification Search ..... 412/1, 412/8, 4, 37, 36, 11, 12, 14, 900; 118/663, 118/664, 708; 270/58.08, 58.09; 399/408
See application file for complete search history.

(56) References Cited

U.S. PATENT DOCUMENTS

| | | | | |
|---|---|---|---|---|
| 4,310,576 | A * | 1/1982 | Hesselmann et al. | 427/207.1 |
| 5,156,510 | A * | 10/1992 | Uehara | 412/8 |
| 5,441,374 | A * | 8/1995 | Kosanke et al. | 412/11 |
| 5,605,575 | A * | 2/1997 | Anderson | 118/679 |
| 6,000,894 | A * | 12/1999 | Suzuki et al. | 412/11 |
| 6,228,172 | B1 * | 5/2001 | Taylor et al. | 118/712 |
| 6,503,040 | B1 * | 1/2003 | Abegglen et al. | 412/37 |
| 6,805,747 | B2 * | 10/2004 | Gore et al. | 118/664 |
| 6,964,707 | B2 * | 11/2005 | Taniguchi et al. | 118/244 |
| 2004/0142105 | A1 * | 7/2004 | Sakurada et al. | 427/256 |
| 2007/0003346 | A1 * | 1/2007 | Higaki et al. | 399/408 |

FOREIGN PATENT DOCUMENTS

| | | |
|---|---|---|
| JP | 2004-209870 | 7/2004 |

OTHER PUBLICATIONS

Office Action from the Japanese Patent Office dated Sep. 30, 2008 (2 pages).

* cited by examiner

*Primary Examiner*—Dana Ross
*Assistant Examiner*—Kyle Grabowski
(74) *Attorney, Agent, or Firm*—Finnegan, Henderson, Farabow, Garrett & Dunner, L.L.P.

(57) ABSTRACT

A bookbinding apparatus includes a coating device for moving relatively to a sheet bundle in the longitudinal direction thereof and for coating an adhesive on the spine of the sheet bundle, a driving device for the relative movement of the coating device, and a control device for controlling the driving device, and according to the thickness of a booklet, changes the number of times of coating of the coating device for one booklet, thereby controls the amount of coating of adhesive.

6 Claims, 2 Drawing Sheets

BOOKBINDING APPARATUS AND IMAGE FORMING SYSTEM

This application is based on Japanese Patent Application No. 2006-233326 filed on Aug. 30, 2006 in Japanese Patent Office, the entire content of which is hereby incorporated by reference.

BACKGROUND OF THE INVENTION

The present invention relates to a bookbinding apparatus and an image forming system having the bookbinding apparatus and more particularly to an art for adhering a plurality of sheets of paper with an adhesive, thereby preparing a booklet.

In the field of light printing, for example, an image forming system is in wide use, in which an image forming apparatus having a high-speed image forming performance such as an electrophotographic image forming apparatus and a bookbinding apparatus are connected, thereby performing a process from printing to bookbinding at one step, and preparing a booklet.

Such an image forming system, unlike a conventional general book manufacturing step for executing separately the printing step and bookbinding step, although the printing speed and bookbinding speed are low, is comprehensively a highly efficient image forming system having an advantage that print contents can be changed easily as required and is used as a POD (print on demand) system.

The characteristic of the POD system is that it is highly flexible such that print contents can be changed as required, thus by the POD system, for example from a booklet of ten and several pages to a booklet of several hundreds pages and various kinds of sheets of paper are used.

On the other hand, the POD system is often installed in an environment such as an office, so that it is required to be small. Therefore, in a bookbinding apparatus composing the system, as a binding step capable of forming booklets by a comparatively simple binding step, a binding step for binding sheets of paper using an adhesive is often used.

Such a bookbinding apparatus is disclosed in Patent Documents 1 and 2.

In Patent Document 1, by changing the height of a scraper roller for controlling the thickness of an adhesive layer coated and formed on the spine of the booklet in correspondence with the thickness of a booklet to be prepared, the amount of coating of adhesive is controlled in correspondence with the thickness of the booklet.

In Patent Document 2, an adhesive is coated by a coating roller moving along the spine of a booklet in the longitudinal direction thereof and by selection of the rotational direction of the coating roller, the amount of coating corresponding to the thickness of the booklet is controlled.

As the POD system, in order to coat uniformly an adhesive of an amount of coating corresponding to a booklet with a greatly different thickness and moreover to respond quickly as required, the coating amount control by changing the height of the scraper roller and changing the rotational direction of the coating roller like Patent Documents 1 and 2 is not sufficient.

Patent Document 1: Unexamined Japanese Patent Application Publication No. 2000-168265

Patent Document 2: Unexamined Japanese Patent Application Publication No. 2004-209753

SUMMARY

One aspect of the constitution of the present invention is as follows:

1. A bookbinding apparatus including a coating device for moving relatively to a sheet bundle in the longitudinal direction thereof and for coating an adhesive on the spine of the sheet bundle, a driving device for the relative movement of the coating device, and a control device for controlling the driving device, wherein the control device changes the number of times of coating by the coating device for the sheet bundle, thereby controlling the amount of coating.

2. An image forming system including an image forming apparatus for forming an image on a sheet of paper and the bookbinding apparatus described in the above item 1 for bookbinding sheets of paper on which images are formed by the image forming apparatus.

DETAILED DESCRIPTION OF THE PREFERRED EMBODIMENT

Figure 1:
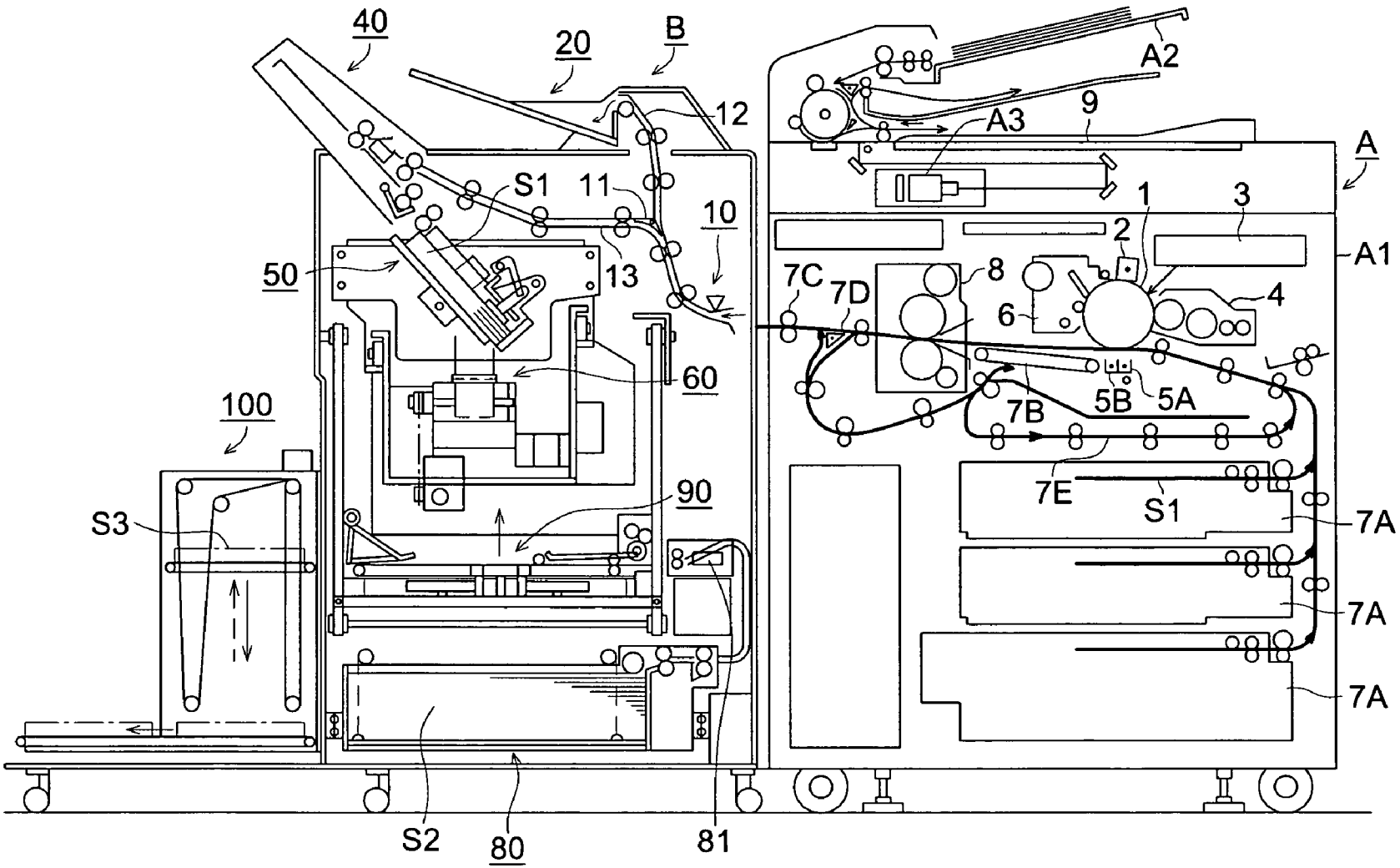
FIG. 1 is a drawing showing the whole image forming system having the bookbinding apparatus relating to the embodiment of the present invention.

The present invention will be explained referring to a preferred embodiment shown in the drawings. However this invention is not limited to the preferred embodiment.

FIG. 1 is a view of the entire image forming system in which a bookbinding apparatus relating to a preferred embodiment of the present invention is equipped.

The image forming system includes image forming apparatus A and bookbinding apparatus B.

Image forming apparatus A electro-photographically forms images on sheets and is equipped with image forming section A1, document feeder A2, and image reader A3.

Image forming section A1 has charging unit 2, exposing unit 3, developing unit 4, transfer unit 5A, separating unit 5B, and cleaning unit 6 around drum-shaped photoreceptor 1. These electro-photographic units perform charging, exposure, development, and transferring in order to form a toner image on the surface of photoreceptor 1 and an image on sheet S1.

Sheets S1 are stored in three sheet supply trays 7A, and delivered one by one from sheet supply trays 7A to transfer unit 5A. Sheet S1 receives a toner image there from photoreceptor 1 by transfer unit 5A.

Sheet S1 with a toner image transferred on it is delivered through fixing unit 8 and fixed there. Fixed sheet S1 is ejected by ejection rollers 7C or delivered to sheet re-feeding path 7E.

For face-down sheet ejection of one-side printing, face-up sheet ejection of one-side printing or front side image forming of both-side image forming, switching gate 7D switches to guide sheet S1. That is, when sheet S1 is ejected with its face up, switching gate 7D delivers sheet S1 straight. When sheet S1 is ejected with its face down or when sheet S1 has images on both surfaces, switching gate 7D delivers sheet S1 downward.

When sheet S1 is ejected with its face down, sheet S1 is guided downward, switched back to move up, and ejected by ejection rollers 7C.

In the both-side image forming, sheet S1 is guided downward, turned upside down with a switchback, delivered again to a transfer section which includes transfer unit 5A through the sheet re-feeding path 7E, and receives another image on the other surface of the sheet.

Document feeder A2 feeds documents one by one to a reading position. Image reader A3 reads the image on a document which is fed from document feeder A2 or placed on document table 9 and generates an image signal.

Bookbinding apparatus B is an apparatus which bundles plural book composing sheets sent from image forming apparatus A into a bundle of the book composing sheets, bonds a cover sheet to the sheet bundle to form a book. On the following explanation, the book composing sheet is called sheet S1, the cover sheet is called cover sheet S2 and the book composing sheets bonded with the cover sheet is called booklet S3.

Bookbinding apparatus B is equipped with sheet conveying section 10 which delivers sheet S1 ejected from image forming apparatus A to sheet ejection tray 20 or sheet reversing section 40, sheet ejection tray 20, sheet reversing section 40, stacking section 50 which receives one or more sheets S1 which are sent at one time and bundles them, coating unit 60, cover sheet storage section 80 which stores cover sheets S2, cover sheet supporting section 90 which supports the cover sheet, and book ejecting section 100.

Sheet S1 ejected from image forming apparatus A is delivered to switching gate 11 in sheet conveying section 10. The switching gate 11 changes sheet paths to send sheet S1 to sheet ejection tray 20 via ejection path 12 or to sheet reversing section 40. In the non-bookbinding mode, sheets S1 are ejected to sheet ejection tray 20.

In the bookbinding mode, sheet S1 is sent to sheet reversing section 40 via sheet conveying path 13, switched back by sheet reversing section 40, and delivered to stacking section 50. A preset number of sheets S1 are stacked in stacking section 50 and when the preset number of sheets S1 have been stacked, stacking section 50 is rotated and the bundle of sheets S1 is held almost vertically.

Coating device 60 applies adhesive to the bottom surface of bundle of sheets S1 which is held vertically by stacking section 50.

Cover sheet S2 is brought into contact with the bundle of sheets S1 which has been coated with adhesive to be bonded to it.

Booklet S3 made by bonding cover sheet S2 to the bundle of sheet S1 is ejected to booklet ejecting section 100.

Figure 2:
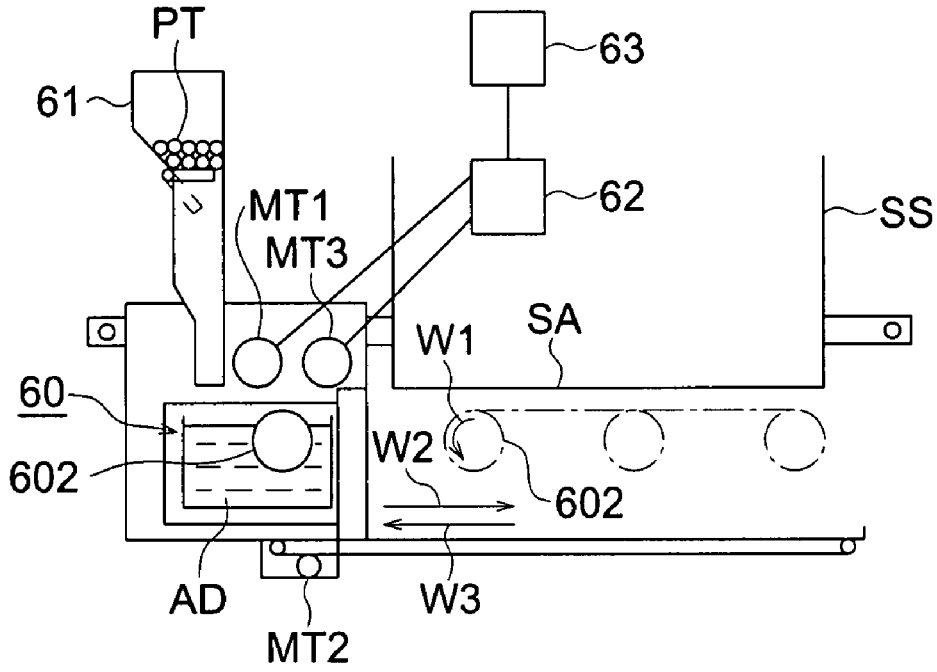
FIG. 2 is a drawing showing the coating step.

FIG. 2 is a drawing showing the coating step.

The coating device 60 is arranged under a sheet bundle SS of sheets S1, and at the time of forward movement indicated by an arrow W2 by driving of a motor MT1 as a driving device, a coating roller 602 coats an adhesive AD on a spine SA of the sheet bundle SS, and also at the time of backward movement indicated by an arrow W3, the coating roller 602 coats the adhesive AD on the spine SA.

The home position of the coating device 60 is the left end position of FIG. 2 and is positioned on the innermost side viewed from the front of a bookbinding apparatus B shown in FIG. 1. At the home position, pellets PT of the adhesive are supplied from a supply device 61. The coating roller 602, at the time of forward movement and backward movement, rotates in the direction indicated by an arrow W1 by driving of a motor MT2, thereby draws up the adhesive from an adhesive tank 601, and coats it on the spine SA of the sheet bundle SS.

Figure 3:
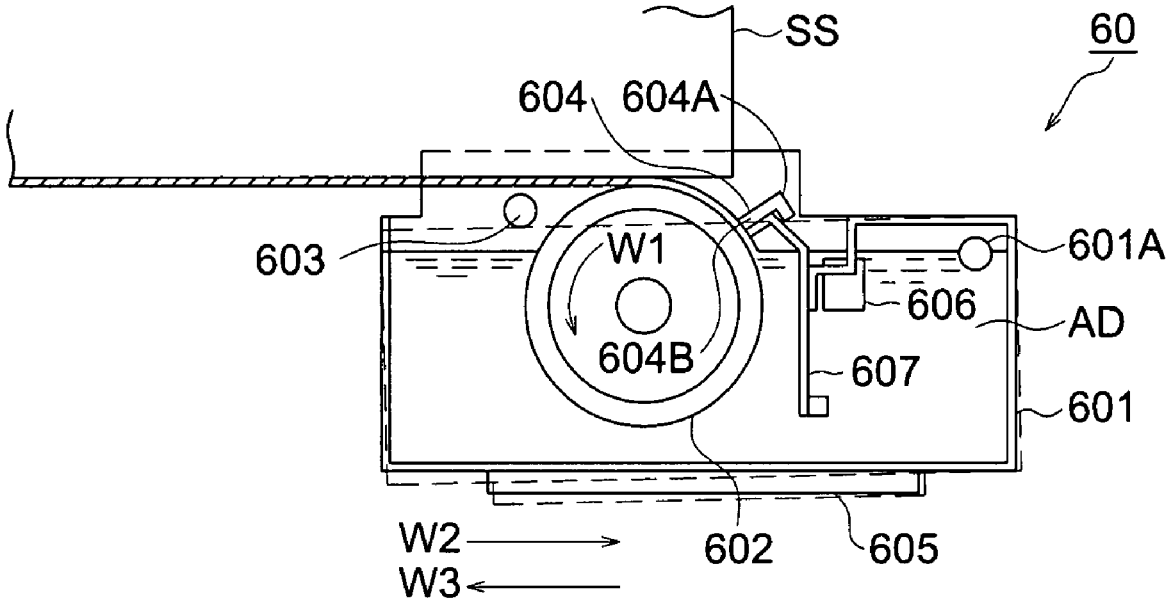
FIG. 3 is a drawing showing the constitution of a coating device 60.

FIG. 3 is a drawing showing the constitution of the coating device 60.

The coating device 60 includes the adhesive tank 601 for storing the adhesive AD, the coating roller 602, control members 603 and 604, a heater 605, and an adhesive amount sensor 606.

Pellets in the adhesive tank 601 are heated and fused by the heater 605, thus a coating liquid of the adhesive AD is formed. The amount of the adhesive AD is detected by the adhesive amount sensor 606 composed of a temperature sensor and the liquid level is kept constant. The control member 604 is supported by a plate-shaped support member 607, and the layer thickness of the adhesive on the coating roller 602 is controlled by a lower edge 604B thereof, and the layer thickness of the adhesive on the spine SA of the sheet bundle is controlled by an upper edge 604A.

The control member 603, when the coating device 60 moves in the direction indicated by the arrow W2 and executes coating, controls the thickness of the coating layer. Further, the control section 604A of the control member 604, when the coating device 60 moves in the direction indicated by the arrow W3 and executes coating, controls the thickness of the coating layer.

The adhesive tank 601 is set by rotating around a shaft 601A from the standby state indicated by a dotted line to the coating state indicated by a solid line.

Coating of the adhesive AD on one sheet bundle SS is finished when the coating device 60 moves back and forth once to several times along the spine SA of the sheet bundle SS.

For example, up to 100 sheets of paper are coated by one go-and-return motion, and 101 to 200 sheets of paper are coated by two go-and-return motions, and 201 to 300 sheets of paper are coated by three go-and-return motions.

The adhesive amount necessary for the sheet bundle SS of 100 sheets of paper is greatly different from the adhesive amount necessary for the sheet bundle SS of 300 sheets of paper. However, coating is executed by changing the number of times of go-and-return motions of the coating device 60 like this, so that coating in greatly different amounts can be accomplished.

Particularly, as in the example explained above, the coating device 60 executes coating at the time of forward movement and at the time of backward movement, so that coating is executed two times by one go-and-return motion, and a uniform coating layer is formed. Further the steps of executing coating at the time of forward movement and at the time of backward movement are repeated, thus a more uniform coating layer is formed.

Furthermore, in each the coating at the time of forward movement and the coating at the time of backward movement, the coating layer thickness is controlled by the control members 603 and 604, thus the uniformity of coating is improved more.

When coating an adhesive in correspondence with the thickness of booklets, it is desirable to adjust the height of the coating device 60 or adjust the heights of the coating roller 602 and control members 603 and 604 so as to widen the gap between the spine SA of the sheet bundle 5S and the coating roller 602 and gaps between the spine SA and control members 603 and 604 more in the second movement than in the first movement and similarly more in the third movement than in the second movement.

Further, in the aforementioned example, the number of times of coating for one sheet bundle SS is decided by controlling the number of times of go-and-return motions of the coating device 60. According to the present invention, with respect to the number of times of coating, the coating executed when the coating device 60 moves once relative to the sheet bundle SS in one direction is referred to as one time of coating, and the number of times of coating is controlled so that the sheet bundle is applied with one time coating when coating is executed only at the time of forward movement or at the time of backward movement, two time coating when coating is executed at the time of one forward and backward movement, and four time coating when coating is executed at the time of two forward and backward movements, and such selection of the number of times of coating can be executed on the basis of information on the thickness of the sheet bundle SS.

When executing coating at time of only either of forward movement and backward movement, it is possible, during coating, to move the adhesive tank 601 in one direction in the state set at the position indicated by a solid line in FIG. 3 and during non-coating, to move the adhesive tank 601 in the opposite direction in the state set at the position indicated by a dotted line in FIG. 3.

At the adhesive coating step, the control device 62 drives the motor MT1 and moves back and forth the coating device 60 in the directions of the arrows W2 and W3 to execute coating. On the basis of information on the number of sheets of paper composing a booklet, paper thickness information, and paper type information from the main body control section 63 which is a control section of an image forming apparatus A (shown in FIG. 1), the number of times of coating is selected, for example, as mentioned above. Furthermore, the control device 62 drives a motor MT3, adjusts the height of the coating device 60 at the time of coating, and controls appropriately the coating layer thickness at each number of times of coating.

Under such control, the number of sheets of paper composing a booklet and paper type are decided by setting of an operator. However, in place of the control for deciding the number of times of go-and-return motions in correspondence with the number of sheets of paper set by the operator, the operator can directly set the number of times of coating, judging from the thickness of the booklet and the control device 62 can execute coating control according to the set number of times, and further the thickness of the sheet bundle SS can be detected in a stacking section 50 (shown in FIG. 1), and on the basis of the detection result, the control device 62 can control the number of times of coating.

Furthermore, in the go-and-return motion of the coating device 60, by combination of coating during forward movement, coating during backward movement, and coating during go-and-return motion, the amount of coating can be controlled more finely.

What is claimed is:

1. A bookbinding apparatus comprising:

a coating device for coating an adhesive on a spine of a bundle of sheets while the coating device moves forwardly and backwardly relative to the bundle of sheets in a longitudinal direction of the bundle of sheets, the coating device comprising:

a coating roller for coating the adhesive on the spine of the bundle of sheets; and at least two control members disposed on opposite sides of the coating roller in the longitudinal direction of the bundle of sheets;

a driving device for conducting the movements of the coating device relative to the bundle of sheets; and a control device for controlling the driving device;

wherein one of the at least two control members controls a thickness of the coated adhesive on the spine of the bundle of sheets by coming in contact with the coated adhesive during a forward movement of the coating device and another one of the at least two control members controls the thickness of the coated adhesive on the spine of the bundle of sheets by coming in contact with the coated adhesive during a backward movement of the coating device, and wherein the control device controls a coating amount on the bundle of sheets by changing a number of times of coating of the coating device.

2. The bookbinding apparatus of claim 1, wherein the control device controls the number of times of coating based on thickness information of the bundle of sheets.

3. The bookbinding apparatus of claim 1, wherein the control device controls the number of times of coating based on set information for the number of times of coating.

4. The bookbinding apparatus of claim 1, wherein the coating device conducts coating both during the forward movement and during the backward movement.

5. An image forming system comprising:

an image forming apparatus for forming an image on a sheet; and the bookbinding apparatus of claim 1 for conducting bookbinding using the sheet on which the image has been formed by the image forming apparatus.

6. An image forming system comprising:

an image forming apparatus for forming an image on a sheet; and a bookbinding apparatus comprising:

a coating device for coating an adhesive on a spine of a bundle of sheets while the coating device moves in a longitudinal direction of the bundle of sheets, the coating device comprising:

a coating roller for coating the adhesive on the spine of the bundle of sheets; and at least two control members disposed on opposite sides of the coating roller in the longitudinal direction of the bundle of sheets;

a driving device for conducting movements of the coating device; and a control device for controlling the driving device;

wherein one of the at least two control members controls a thickness of the coated adhesive on the spine of the bundle of sheets by coming in contact with the coated adhesive during a forward movement of the coating device and another one of the at least two control members controls the thickness of the coated adhesive on the spine of the bundle of sheets by coming in contact with the coated adhesive during a backward movement of the coating device, and wherein the control device controls a coating amount on the bundle of sheets by changing a number of times of coating of the coating device.

* * * * *